US008435048B2

(12) United States Patent
Fahllund et al.

(10) Patent No.: US 8,435,048 B2
(45) Date of Patent: May 7, 2013

(54) CONNECTOR

(75) Inventors: Jan H. Fahllund, Lieto (FI); Kai Silvennoinen, Lieto (FI); Osmo Knuuttila, Turku (FI)

(73) Assignee: Nokia Corporation, Espoo (FI)

( * ) Notice: Subject to any disclaimer, the term of this patent is extended or adjusted under 35 U.S.C. 154(b) by 188 days.

(21) Appl. No.: 12/664,295

(22) PCT Filed: Jun. 11, 2007

(86) PCT No.: PCT/EP2007/005124

§ 371 (c)(1),
(2), (4) Date: Jun. 14, 2010

(87) PCT Pub. No.: WO2008/151641

PCT Pub. Date: Dec. 18, 2008

(65) Prior Publication Data

US 2011/0053399 A1 Mar. 3, 2011

(51) Int. Cl.
*H01R 12/00* (2006.01)

(52) U.S. Cl.
USPC ..... 439/76.1; 439/328

(58) Field of Classification Search ..... 439/76.1, 439/327, 328, 248, 929
See application file for complete search history.

(56) References Cited

U.S. PATENT DOCUMENTS

| | | | | |
|---|---|---|---|---|
| 3,596,018 | A | 7/1971 | Elmes | |
| 5,588,850 | A | 12/1996 | Pan et al. | |
| 6,045,386 | A * | 4/2000 | Boe | 439/327 |
| 6,193,546 | B1 * | 2/2001 | Sadler | 439/534 |
| 6,655,985 | B2 * | 12/2003 | Huang et al. | 439/533 |
| 6,942,514 | B1 * | 9/2005 | Cheng et al. | 439/328 |
| 7,140,900 | B1 * | 11/2006 | Villanueva | 439/327 |
| 7,144,276 | B1 * | 12/2006 | Yang | 439/630 |
| 7,182,618 | B1 * | 2/2007 | Choy et al. | 439/328 |
| 7,238,042 | B2 * | 7/2007 | Chen et al. | 439/374 |
| 7,275,963 | B2 * | 10/2007 | Kurita | 439/630 |
| 2004/0185687 | A1 | 9/2004 | Liao et al. | |

FOREIGN PATENT DOCUMENTS

| | | | |
|---|---|---|---|
| EP | 0284431 | A | 9/1988 |
| WO | 95/10129 | A | 4/1995 |
| WO | 03/003527 | A | 1/2003 |

OTHER PUBLICATIONS

International Search Report and Written Opinion received in corresponding Patent Cooperation Treaty Application No. PCT/EP2007/005124, Feb. 5, 2008, 10 pages.

* cited by examiner

*Primary Examiner* — Hien Vu
(74) *Attorney, Agent, or Firm* — Harrington & Smith

(57) ABSTRACT

A connector includes a connector assembly is supported by a moveable member that can move relative to a printed wired board in two directions and is urged to its center position by two oppositely disposed springs that each urge a contact member into a respective recess.

15 Claims, 2 Drawing Sheets

CONNECTOR

RELATED APPLICATION

This application was originally filed as PCT Application No. PCT/EP2007/005124 on Jun. 11, 2007, which is incorporated herein by reference in its entirety.

FIELD OF THE INVENTION

The present invention relates to electrical connectors for coupling electronic devices to another device, for example in desk stands or other cradles.

BACKGROUND OF THE INVENTION

Stroke type pairs e.g. between digital cameras and their desk stands are known in the art. Perfect alignment between the connectors just before establishing the connection is very difficult to achieve and a certain degree of misalignment has to be accepted. In known desk stand solutions these tolerances are handled with one or two floating printed wired boards and with one captive cable that is fixed/soldered permanently to the printed wired board inside the desk stand or inside the desk stand there is floating printed wired board and a separate flexible printed circuit connected to the external I/O connector. Known floating connectors often have only one direction of movement and/or are not self centering and/or have a complicated construction.

DISCLOSURE OF THE INVENTION

On this background, it is an object of the present invention to provide a moveable or floating connector that at least partially overcomes the problems described above. This object is achieved in accordance with claim 1 by providing a self centering moveable connector comprising a fixed printed wired board; an electrical connector assembly carried by a moveable member; the moveable member being moveable in the plane of the printed wired board in two directions and the moveable member having a central position relative to the printed wired board; two oppositely disposed resilient members urging the moveable member towards its central position in the two directions in which the moveable member can move.

Thus, a relatively simple self centering floating/moveable connector with two degrees of freedom is realized.

The connector may further comprise a contact member that is urged by the resilient member into a recess that is formed in one of the components of the connector, the recess being positioned so that the connector is in its center position in a first of the two directions when the contact member is urged into contact with the deepest portion of the recess and wherein any deviation of the center position in the first direction causes the contact member to be forced to move away from the deepest portion against the force of the resilient member.

The contact member may interact with a recess in a stationary part of the connector, with the resilient member being disposed between the moveable member and the contact member. Alternatively, the contact member may interact with a recess in a moveable part of the connector, with the resilient member being disposed between a stationary member of the connector and the contact member.

The contact member can be an integral part of the resilient member.

The resilient member can be a leave spring.

The contact member can be formed by a curved portion at the free end of the leave spring.

The moveable member may comprise a bracket that is wrapped around the printed wired board for controlling the distance between the printed wired board and the moveable member.

Electrical contact between the electrical connector assembly and the printed wired board may include resilient contacts that interact with contact surfaces.

The moveable member can be suspended from the printed wired board.

It is another object of the invention to provide a self centering moveable connector comprising a fixed printed wired board, an electrical connector assembly carried by a moveable member, the moveable member being moveable in the plane of the printed wired board in two directions and the moveable member having a central position relative to the printed wired board, the electrical connector assembly being electrically connected to the printed wired board by resiliently contact members that are in sliding contact with surface contacts.

Thus, the flowing connector is obtained that does not need to use flexible printed circuit board or the like before establishing a connection between the static printed wired port and the connector block.

The surface contacts can be disposed on the printed wired board and the resilient contacts are carried by the electrical connector assembly.

The resilient contacts can be biased towards the respective surface contact

The resilient contacts can be pogo contacts.

The resilient contacts can be spring wire contacts.

It is another object of the present invention to provide method of assembling a housing for a moveable connector that requires a less precise handling of the housing parts.

This object is achieved by providing a method of assembling a housing for moveable connector, the housing comprising at least two housing parts that are connected to one another with a given tolerated inaccuracy, the method comprising exploiting the moveable capacity of the connector during the assembly of the two housing parts to compensate for the tolerated inaccuracy.

Further objects, features, advantages and properties of the moveable connector to the invention will become apparent from the detailed description.

BRIEF DESCRIPTION OF THE DRAWINGS

In the following detailed portion of the present description, the invention will be explained in more detail with reference to the exemplary embodiments shown in the drawings, in which.

DETAILED DESCRIPTION OF PREFERRED EMBODIMENTS

In the following detailed description, the connector according to the invention will be described by the preferred embodiments.

Figure 1:
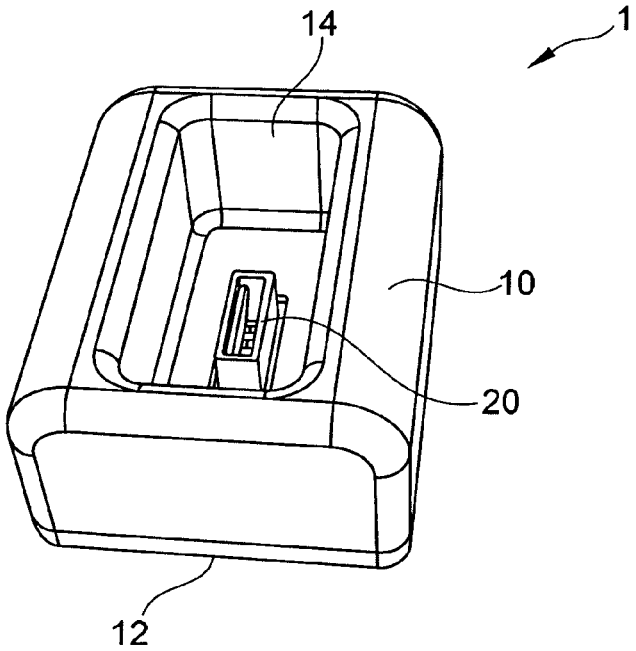
FIG. 1 is an elevational view of a docking cradle including a moveable connector according to an embodiment of the invention.

With reference to FIG. 1 the movable/floating connector according to an embodiment of the invention is included in a cradle or desk stand 1. The cradle 1 includes a housing 10 that includes a base 12 the housing 10 defines a bay 14. The bay 14 is designed for receiving a portion of a peripheral device, such as a mobile phone, a personal navigation assistant, a music or multimedia player, a camera, a palmtop computer other portable or mobile electronic device for creating an electrical connection therewith and for supporting the peripheral device.

An electrical connector assembly 20 is placed at the bottom of the bay 10.

Figure 2:
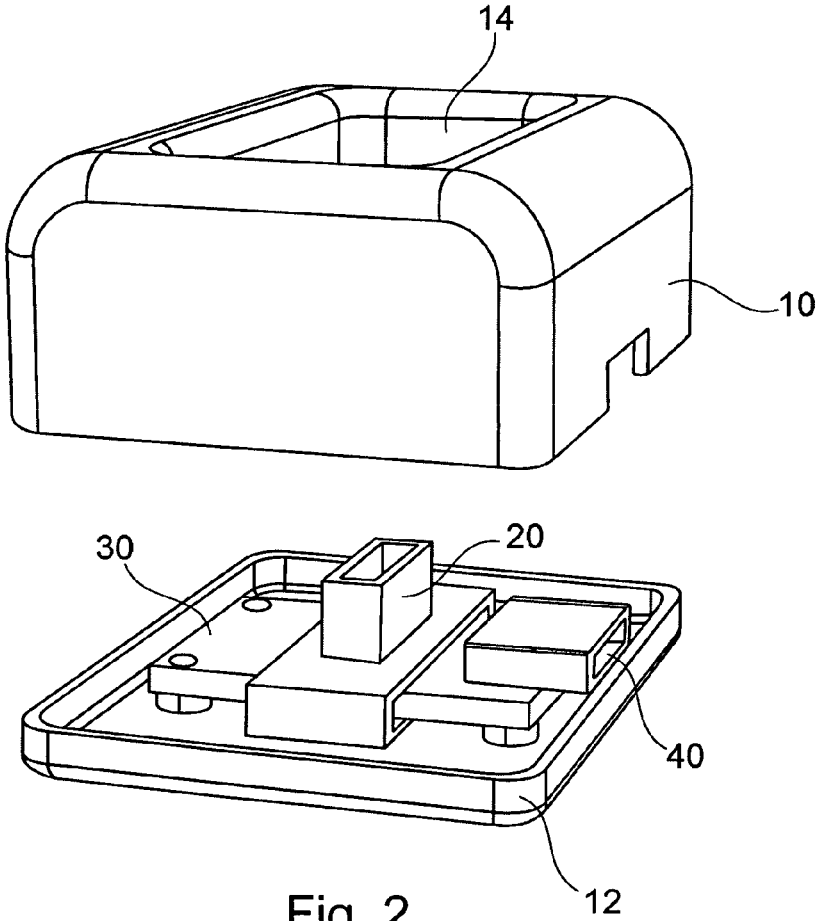
FIG. 2 is an elevational exploded view of the docking cradle shown in FIG. 1 with the moveable connector visible.

With reference to FIG. 2 the electrical connector assembly 20 is suspended from a printed wired board 30. Another connector assembly 40 is attached to the printed wired board 30. The connector assembly 40 is fixed (not moveable/floating) and serves to connect the cradle 1 via a cable to another device (not shown). The connector assembly 40 could for example be a USB connector that can be used to connect the cradle 1 and the peripheral device to a computer (not shown).

The printed wired board 30 is secured to the base 12 with spacers at the corners of the printed wired board 30 for keeping a certain distance between the printed wired board 30 and the base 12.

Figure 3:
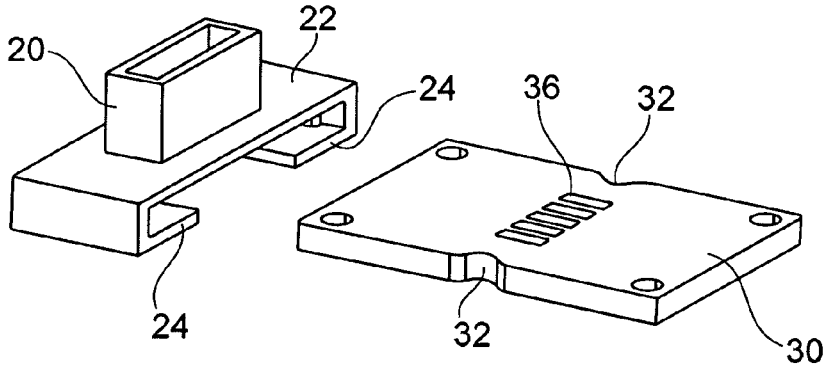
FIG. 3 is an exploded elevational view of some of the components of the moveable connector shown in FIG. 2.
Figure 4:
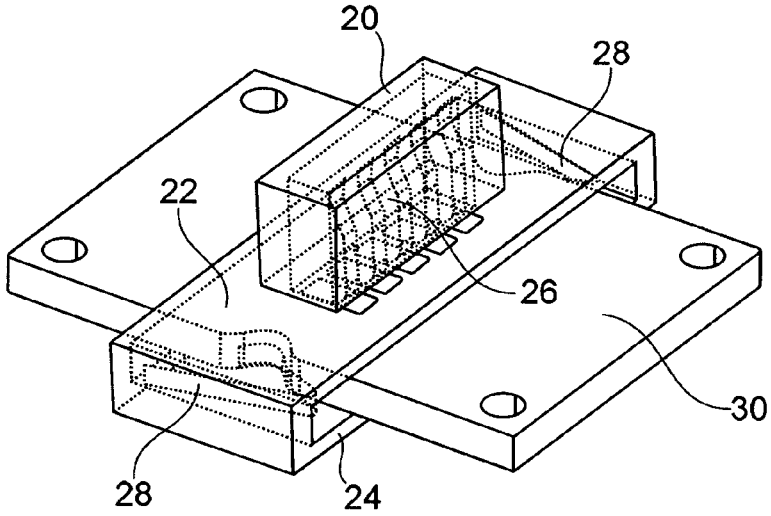
FIG. 4 is an elevational view of the moveable connector shown in FIG. 2 with some parts of the connector being represented as transparent for illustrative purposes.

FIGS. 3 and 4 show the components of the moveable and self centering connector in greater detail. The connector assembly 20 is carried by a moveable member 22 that is formed as a bracket with inwardly directed ledges 24 that wrap around in the printed wired board 30. The ledges 24 control the distance between the moveable member 22 and the upper surface of the printed wired board 30. The width of the moveable member 22 and the width of the printed wired board are chosen such that there is space for placing resilient members 28 between the bracket and the sides of the printed wired board 30. The resilient members will be described in greater detail herebelow.

The opposing long sides of the printed wired board 30 are each provided with a recess 32, that is shaped to receive a resiliently urged contact member that will be described herebelow. The recess 32 may be arch shaped, V-shaped or may have any other shape that results in a recess with a deepest central portion.

The printed wired board 30 is provided with a plurality of surface contacts 36 that establish electrical connection with the connector assembly 20 by resilient contacts 26 (spring wire contacts) that are provided in the connector assembly 20. The resilient contacts 26 urge the moveable member 22 with the connector assembly thereon in an upward direction, but this movement is limited by the ledges 24. In an embodiment (not shown) pogo contacts/pogo pins are used instead of the leave spring contacts (pogo contacts being spring biased plunger type contacts). The arrangement of the surface contacts 36 and the resilient contacts 26 allows the connector assembly 20 to move above the printed wired board 30 over a limited extent in any direction parallel to plane of the printed wired board 30 the whilst being electrically connected to the printed wired board 30.

Inside the bracket of the moveable member 28 a resilient member 28 is provided on each side of the printed wired board 30.

Figure 5:
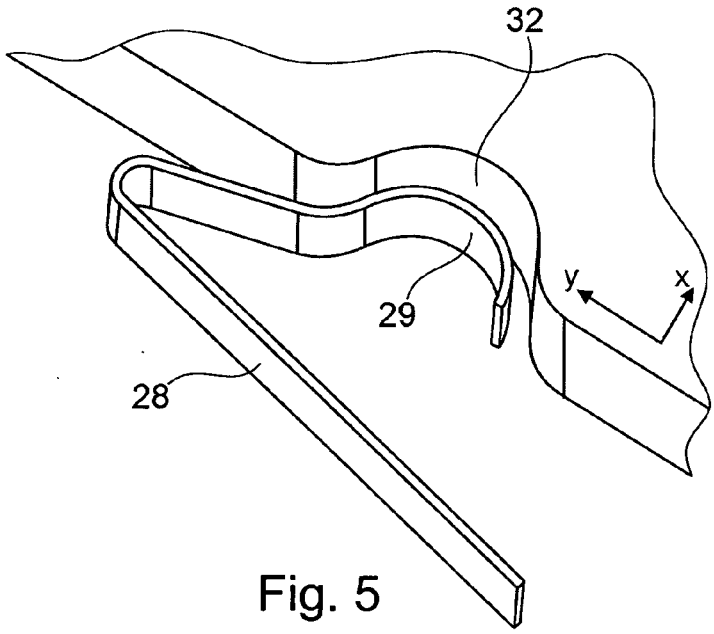
FIG. 5 is elevational view on a detail of the moveable connector shown in FIG. 2.

As can be seen in detail in FIG. 5, the resilient members 28 are leaf springs that have one of their ends attached to the moveable member 22 with their other free end forming a contact member 29 that fits into the respective recess 32 in the side of the printed wired board 30. In this embodiment that the contact members 29 are formed by an arch shaped end portion of the leave springs 28. However, it is understood that the contact member 29 does not need to be exactly arch shaped as long as it has a shape that allows the creation of a reactive force with the surface of the recess 32 in the correct direction. Further, the contact member 29 does not need to be an integral part of the spring.

The recesses 32 are shown as arch shaped recesses, but it is understood that V-shaped recesses or any other recesses with a shape that converges to a central deepest portion would be suitable for use with the present invention.

The recesses 32 are positioned such that the connector assembly 20 is in its center position when the contact members 29 are fully received into the respective recess 32, i.e. the contact members 29 are in contact with the deepest portion of the recesses 32.

The contact member 29 and the recess 32 have shapes that are adjusted to one another with the aim of ensuring that a movement of the moveable member 22 relative to the printed wired board 30 in the direction of the arrow "y" results in a compression of the leave spring 28 and results in a reactive force caused by the shapes of the contact member 29 and the recess 32 that urges the moveable member 22 back to the center position in the "y" direction.

The balance between the opposing leaf springs 28 on each side of the printed wired board 30 urges the moveable member 22 and the connector assembly 20 back to the center position in the "x" direction when the moveable member 22 gets outside its center position in the "x" direction.

Thus, a combination of two opposing balanced resilient members and contact members that are urged by the resilient members into recesses with a suitable shape and a position allows the connector to float in any direction in a given plane and be self centering.

The construction of the connector according to the embodiment described above may be reversed (not shown), with the leave brings being connected to the printed wired board and the recesses being formed in the moveable member. Further, any other type of springs that are capable of urging a contact member into a recess are suitable for use with the present invention.

According to another embodiment (not shown) there can be more than two springs that bias the moveable part of the connector to its center position. For example, there could be three resilient members that have their spring force and travel directed in the plane of movement of the moveable member, such as three or four leave springs or three or four coil springs that are essentially distributed at substantially equal angular distance around the moveable member. In such an embodiment with three or more springs it would not be necessary to deploy recesses in the edges of the printed wired board and the corresponding to contact members at the ends of the present and members, since the three or more resilient members will be able to bias the flowing member towards its center position in both the x and y direction without the need for to recesses and engagement members.

According to an embodiment (not shown) the connector is part of a mobile electronic device, e.g. a media player, a mobile phone, a navigation device, a photo camera, a PC or, a laptop or a palmtop or the like and any complementary electronic devices thereto.

During assembly of the housing 10 with the base 12, a given inaccuracy tolerance between the assembled housing parts has to be accepted since a perfect tolerance cannot be achieved in a commercial production. During the assembly of the housing part 10 onto the base 12 the floating and self centering capacity of the connector block 20 is exploited. The connector block 20 will move to adapt to any possible misalignment between the opening in the bay 14 and the connector block 20 when the two housing parts 10,12 are assembled. Thus, any misalignment between housing parts 10,12 will not lead to problems with the connector block not being able to pass through the opening in the bottom of the bay 14.

The invention has numerous advantages. Different embodiments or implementations may yield one or more of the following advantages. It should be noted that this is not an exhaustive list and there may be other advantages which are not described herein. One advantage of the invention is that it provides for a moveable and self centering connector with two degrees of freedom that is a relatively simple in construction. Another advantage of the invention is that it provides for a moveable connector with only one stationary printed wired board.

Another advantage of the invention is that it does not require the use of a flexible printed circuit or cable for connecting a connector assembly to a printed wired board.

The term "comprising" as used in the claims does not exclude other elements or steps. The term "a" or "an" as used in the claims does not exclude a plurality.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon. Moreover, it should be appreciated that those skilled in the art, upon consideration of the present disclosure, may make modifications and/or improvements on the apparatus hereof and yet remain within the scope and spirit hereof as set forth in the following claims.

The invention claimed is:

1. A connector comprising:

a printed wired board;

an electrical connector assembly carried by a moveable member, said moveable member being in the form of a bracket having a substantially C-shaped cross section with inward ledges directed toward one another, said printed wired board being within said substantially C-shaped cross section of said moveable member, said moveable member being slidably moveable on said printed wired board in lengthwise and widthwise directions relative thereto, and said moveable member having a desired position relative to the printed wired board in said lengthwise and crosswise directions;

two substantially oppositely disposed resilient members within said substantially C-shaped cross section on opposite sides of said printed wired board, said resilient members urging the moveable member towards said desired position in said lengthwise and widthwise directions, and said resilient members centering said moveable member in a widthwise direction and fixing said moveable member in a lengthwise direction of said printed wired board;

wherein said resilient members each have a contact member, and wherein at least one of said printed wired board and said moveable member has a recess to accommodate said contact member.

2. A connector according to claim 1, wherein said recess is positioned so that said moveable member is in said desired position in said lengthwise direction when the contact member is urged into contact with a deepest portion of the recess and wherein any deviation from said desired position in said lengthwise direction causes the contact member to be forced to move away from said deepest portion against the force of the resilient member.

3. A connector according to claim 2, wherein said contact member interacts with a recess in said printed wired board of said connector, with said resilient member being disposed between said moveable member and said contact member.

4. A connector according to claim 2, wherein said contact member interacts with a recess in said moveable member of the connector, with said resilient member being disposed between said printed wired board of the connector and said contact member.

5. A connector according to claim 2, wherein said contact member is an integral part of the resilient member.

6. A connector according to claim 5, wherein said resilient member is a leaf spring.

7. A connector according to claim 6, wherein said contact member is formed by a curved portion of said leaf spring.

8. A connector according to claim 2, wherein said bracket is substantially wrapped around the printed wired board.

9. A connector according to claim 2, wherein electrical contact between said electrical connector assembly and said printed wired board includes resilient contacts that interact with surface contacts.

10. An electronic device including a connector according to claim 1.

11. A connector comprising:

a printed wired board, said printed wired board having a plurality of surface contacts;

an electrical connector assembly carried by a moveable member, said moveable member being in the form of a bracket having a substantially C-shaped cross section with inward ledges directed toward one another, said printed wired board being within said substantially C-shaped cross section of said moveable member, said moveable member being slidably moveable on said printed wired board in lengthwise and widthwise directions relative thereto, and said moveable member having a desired position relative to the printed wired board in said lengthwise and crosswise directions;

said electrical connector assembly having a plurality of resilient contact members, and being electrically connected to the printed wired board by said resilient contact members being in sliding contact with said surface contacts;

wherein said resilient contact members are biased towards the respective surface contacts.

12. A connector according to claim 11, wherein said resilient contact members are pogo contacts.

13. A connector according to claim 11, wherein said resilient contact members are spring wire contacts.

14. A connector according to claim 11, wherein said bracket is substantially wrapped around the printed wired board.

15. An electronic device including a connector according to claim 11.

* * * * *